US005442823A

United States Patent [19]

Siekman et al.

[11] Patent Number: 5,442,823

[45] Date of Patent: Aug. 22, 1995

[54] WHEELCHAIR CUSHION UTILIZING FOAMS OF DIFFERENT STIFFNESSES

[75] Inventors: Allen R. Siekman, Amherst; Julius E. Nachod, III, Lakewood, both of Ohio

[73] Assignee: Invacare Corporation, Elyria, Ohio

[21] Appl. No.: 1,381

[22] Filed: Jan. 6, 1993

[51] Int. Cl.[6] ..... A47C 27/15; A47C 7/02

[52] U.S. Cl. ..... 5/653; 297/452.27; 297/DIG. 1

[58] Field of Search ..... 5/453, 454; 297/452.27, 297/452.26, DIG. 1

[56] References Cited

U.S. PATENT DOCUMENTS

| | | | |
|---|---|---|---|
| D. 335,235 | 5/1993 | Hildreth | D6/601 |
| 3,612,607 | 10/1971 | Lohr | 297/452.27 |
| 3,751,111 | 8/1973 | Taylor et al. | 297/DIG. 1 |
| 3,987,507 | 10/1976 | Hall | 5/653 |
| 4,405,681 | 9/1983 | McEvoy | 428/309.9 |
| 4,522,447 | 6/1985 | Snyder et al. | 5/653 |
| 4,571,763 | 2/1986 | Suzuyama et al. | 297/DIG. 1 |
| 4,670,925 | 6/1987 | Carussi | 297/DIG. 1 |
| 4,726,086 | 2/1988 | McEvoy | 297/DIG. 1 |
| 4,753,480 | 6/1988 | Morell | 5/653 |
| 4,755,411 | 7/1988 | Wing et al. | 297/DIG. 1 |
| 4,819,288 | 4/1989 | Lowthian | 5/653 |
| 4,837,881 | 6/1989 | Kondo et al. | 297/DIG. 1 |
| 4,912,788 | 4/1990 | Lonardo | 5/653 |
| 4,930,171 | 6/1990 | Frantz | 5/654 |
| 4,951,334 | 8/1990 | Maier | 5/653 |
| 4,960,304 | 10/1990 | Frantz | 297/DIG. 1 |
| 5,000,515 | 3/1991 | Deview | 297/DIG. 1 |
| 5,018,790 | 5/1991 | Jay | 5/653 |
| 5,052,068 | 10/1991 | Graebe | 5/654 |
| 5,163,737 | 11/1992 | Navach et al. | 5/653 |
| 5,189,747 | 3/1993 | Mundy et al. | 297/452.27 |
| 5,317,773 | 6/1994 | Graebe | 5/653 |
| 5,343,876 | 9/1994 | Rogers | 5/654 |
| 5,352,023 | 10/1994 | Jay et al. | 5/654 |
| 5,369,828 | 12/1994 | Graebe | 5/654 |

FOREIGN PATENT DOCUMENTS

| | | | |
|---|---|---|---|
| 1271660 | 8/1961 | France | 5/653 |

*Primary Examiner*—Alexander Grosz

*Attorney, Agent, or Firm*—Fay, Sharpe, Beall, Fagan, Minnich & McKee

[57] ABSTRACT

A polyurethane foam wheelchair cushion comprises first, second, third and fourth elements. The first element extends across the front portion of the cushion and is made of a relatively stiff foam. The second element is centered near the back portion of the cushion and is made of a foam with a lower stiffness than the first element. Third and fourth elements are on either side of the second element and are made of a foam having an intermediate stiffness between the first element and the second element. Transition surfaces between the second and third and fourth elements are angled relative to a vertical plane. Such an angled transition surface provides a gradual change in stiffness in the vertical direction between materials of different stiffnesses. The top surface of the first element is oriented relative to the second element so that the user's ischial tuberosities will be located approximately 1.5 inches lower than the back surface of the user's thighs when the user is sitting in the wheelchair cushion.

25 Claims, 2 Drawing Sheets

FIG. 2
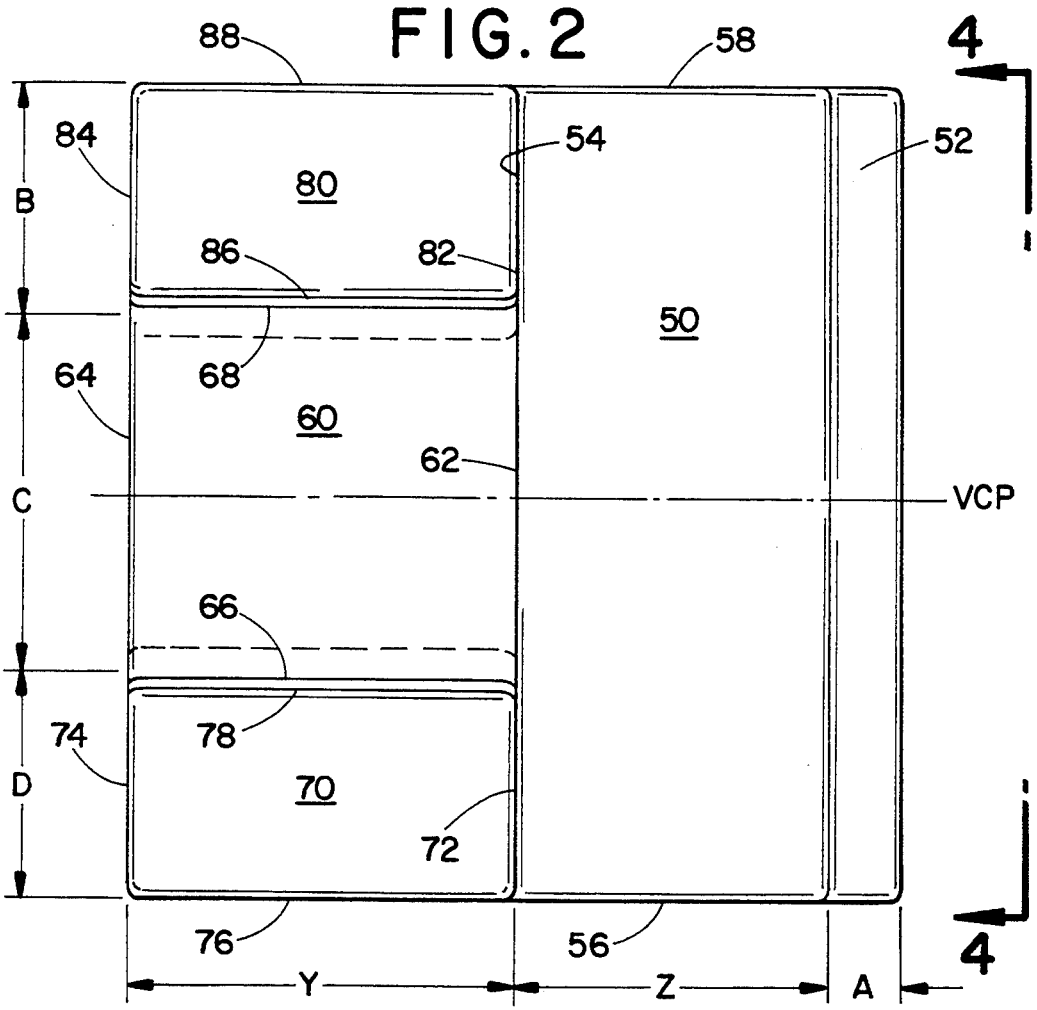
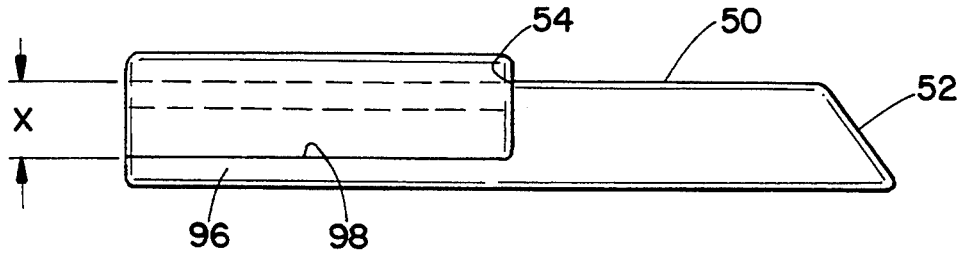
FIG. 3
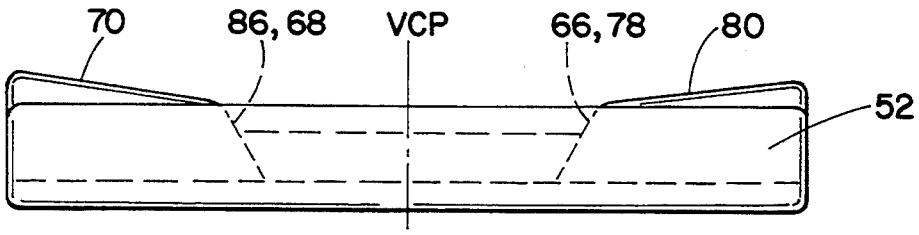
FIG. 4

WHEELCHAIR CUSHION UTILIZING FOAMS OF DIFFERENT STIFFNESSES

BACKGROUND OF THE INVENTION

1. Field of the Invention

This invention relates to the art of cushions for wheelchairs, and more specifically to foam cushions for wheelchairs, and even more specifically to foam cushions designed to reduce pressure on the ischial tuberosities of the user and increase lateral pelvic stability.

2. Description of the Related Art

Users of wheelchairs are often unable to walk or stand. As such, they commonly spend long hours in a sitting position. Further, many of these users have no sense of feeling below their waist. They are unable to realize when portions of their body are being uncomfortably pinched between their bones and the supporting seat of the wheelchairs. If this situation goes undiscovered, painful and unhealthy sores can develop in the user's body under these bony prominences.

The primary bony prominence causing such difficulties are the ischial tuberosities of the user's pelvic structure. In the past, wheelchair cushion manufacturers have sought to address this problem by providing variously configured seat cushions to relieve the pressure on these ischial tuberosities. Some of the wheelchairs seat cushions have addressed this problem by the use of different density foams under the various portions of the user's buttocks and thigh region in an effort to support the user's weight and relieve the pressure on the ischial tuberosities.

One example of such a structure is disclosed in U.S. Pat. No. 3,987,507 to Hall wherein a pad assembly is made up of three pads of resilient foam material. A center pad has a greater density than the outer pads. The center pad also has three cut out openings at locations which correspond to the maximum pressure points exerted by a person sitting on the pads.

Another cushion utilizing foams of different densities is disclosed in U.S. Pat. No. 4,522,447 to Snyder et al. wherein the seat cushion comprises segments having different moduli of elasticity.

In U.S. Pat. No. 4,753,480 to Morell, a wheelchair cushion has a bottom pad of resilient foam material of high density and at least one upper pad of resilient foam material of intermediate density having a cut out therethrough. Filler foam material of low density is frictionally mounted as an insert in at least one of the openings of one of the upper pads.

In U.S. Pat. No. 4,819,288 to Lowthian, a foam wheelchair cushion features blocks and higher density foam in an intermediate layer than in an outer layer.

In U.S. Pat. No. 4,951,334 to Maier, a pressure relief cushion having a spring rate of about 75 to 300 pounds per inch features two different resilient materials, each having a different indentation force deflection rating and being substantially U-shaped.

While some of these prior art cushions have proven to be effective in some applications, improvements were desirable. Some of the designs were rather complex, requiring a high degree of precision in the assembly process as well as a corresponding higher cost. Further, some of the designs did not relieve pressure on the ischial tuberosities to the degree desired.

The present invention contemplates a new and improved wheelchair seat cushion which is simple in design, effective in use, and overcomes the foregoing difficulties and others while providing better and more advantageous overall results.

SUMMARY OF THE INVENTION

In accordance with the present invention, a new and improved wheelchair cushion is provided which is adapted to relieve pressure on the ischial tuberosities of a user.

More particularly, in accordance with the invention, a wheelchair cushion comprises a first element and a second element. The first element has a first stiffness and a side transition surface. The second element has a second stiffness and a second element side transition surface. The first element side transition surface is contiguous with the second element side transition surface. The side transition surfaces lie within a transition plane which makes an angle between 10° and 80° with a first vertical plane.

According to another aspect of the invention, a wheelchair cushion has a first element, a second element, and third elements. The first element has a first stiffness and a thickness. The front surface of the first element comprises the front surface of the cushion and selectively receives the back surface of the thighs of the associated user. The second element also has a second stiffness and a thickness the second stiffness is less than the first stiffness. The second element also has a second stiffness and a thickness. The back surface of a second element comprises the back surface of the cushion and receives the ischial tuberosities of the associated user. The second stiffness is less than the first stiffness so that the ischial tuberosities of the associated user will be located between 1.0 inches and 2.0 inches below the back surface of the user's thighs. One of the third elements is located on either side of the second element. The third elements have a third stiffness which is less than the first stiffness but greater than the second stiffness. The third elements receive the outer buttocks region of the associated user when the user is sitting on the cushion, thereby supporting the user's weight and reducing pressure on the user's ischial tuberosities. The top surfaces of the third elements are inclined toward a vertical center plane of the cushion. The side surfaces of the third elements are adjacent to the side surfaces of the second element. The side surfaces of the second and third elements made an angle between 10° and 80° with a first vertical plane.

According to a still further aspect of the invention, a wheelchair cushion comprises first, second, third, and fourth elements. The first element has a front surface which comprises the front surface of the cushion. The second element has a front surface which is adjacent the back surface of the first element. The back surface of the second element comprises a part of the back surface of the cushion. The third element has a front surface which is contiguous with the back surface of the first element. The right side surface of the third element is contiguous with the left side surface of the second element. The back surface of the third element comprises part of the back surface of the cushion. A fourth element has a front surface which is contiguous with the back surface of the first element. The fourth element also has a left side surface which is contiguous with the right side surface of the second element. The back surface of the fourth element comprises part of the back surface of the cushion. The first element further comprises a plate portion which extends under the second third and fourth elements. The average width of the second element is between four inches and eight inches. The top surface of the first element extends rearwardly from the front surface of the cushion a distance between four inches and nine inches.

According to still another aspect of the invention, the first element has a first stiffness between 60 ILD and 120 ILD. The second element has a second stiffness between 25 ILD and 35 ILD. The third elements have a third stiffness between 40 ILD and 65 ILD.

One advantage of the present invention is the provision of a new and improved foam wheelchair cushion.

Another advantage of the invention is the provision of three different densities of foam strategically placed in the cushion to support the weight of the user while providing maximum protection for the tissues surrounding the ischial tuberosities.

Another advantage of the invention is the provision of a first element which receives the back surface of the thighs of the associated user. The first element is made of a stiff foam which, not only helps support the user's weight, but also aids in the transition of the user out of the wheelchair. Typically, the user slides forward when exiting the wheelchair, placing all of their weight on the first element. The firmness of the first element assists in the exiting of the wheelchair.

Another advantage of the present invention is the provision of a taper to the front surface of the cushion. The taper is more comfortable for the user's thighs and also assists in the transition of the user exiting the wheelchair.

Another advantage of the invention is the provision of a slanted top surface in the third and fourth elements. The top surface of the third and fourth elements slant inwardly toward a vertical center plane of the cushion. Such a slant helps center the user's body in the center of the wheelchair cushion. This in conjunction with the firm front foam. The geometry of the entire cushion helps prevent the user from swaying back and forth.

Another advantage of the invention is the provision of a relatively less stiff foam in the region of the ischial tuberosities of the user. The soft foam is surrounded by foams of higher stiffnesses. Therefore, when the user sits on the cushion, other parts of the body more able to take stress, support the user's weight while the ischial tuberosities and surrounding tissues can sink into the soft foam of the second element without pinching tissues around the ischial tuberosities.

A still further advantage of the invention is the provision of soft foam in the second element which is 1.0 inches thick. When the user places their ischial tuberosities over the second element and sits down, the ischial tuberosities tend to orient themselves approximately 1.5 inches beneath the top surface of the first element which is contiguous with the back surface of the user's thighs. It has been discovered that positioning the ischial tuberosities approximately 1.5 inches below the back surface of the user's thighs is helpful and advantageous for the user.

Another advantage of the present invention is the provision of a plate extending from the first element under the second, third and fourth elements. The plate adds to the structural rigidity of the cushion as well as providing further cushioning beneath the soft second element.

Another advantage of the invention is the provision of tapering side surfaces between the second third and fourth elements. The tapering side surfaces provide a gradual transition and stiffness in the vertical direction for the user. The tapers also provide structural integrity and provide a resistance to the dislodgement or misplacement of the second element relative to the third or fourth.

Still other benefits and advantages of the invention will become apparent to those skilled in the art upon a reading and understanding of the following detailed specification.

BRIEF DESCRIPTION OF THE DRAWINGS

The invention may take physical form in certain parts and arrangements of parts, a preferred embodiment of which will be described in detail in this specification and illustrated in the accompanying drawings which form a part hereof, and wherein:

FIG. 2 is a plan view of a seat cushion according to the invention;

FIG. 3 is a side view of a seat cushion according to the invention; and,

FIG. 4 is a rear view of a seat cushion according to the invention.

DESCRIPTION OF PREFERRED EMBODIMENT

Figure 1:
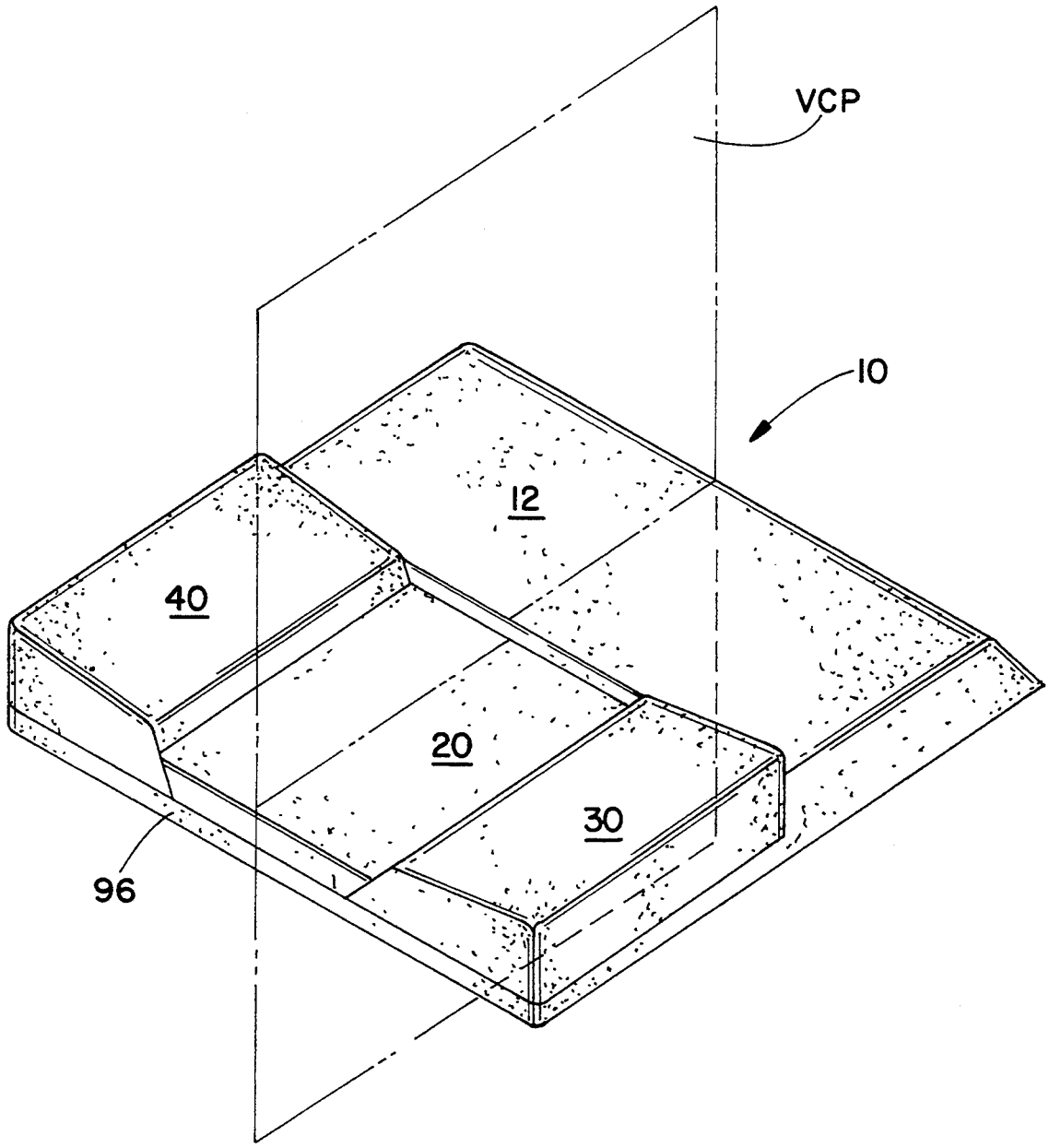
FIG. 1 is a perspective view of a seat cushion according to the invention.

Referring now to the drawings, wherein the showings are for purposes of illustrating a preferred embodiment of the invention only and not for purposes of limiting same, FIG. 1 shows a seat cushion 10 according to the invention. In the preferred embodiment the cushion 10 is used in conjunction with a cover (not shown). The cushion 10 essentially comprises first element 12, second element 20, third element 30, and fourth element 40. With reference to FIGS. 2 and 3, the first element 12 has a top surface 50, a front surface 52, a rear surface 54, a right side surface 56, and a left side surface 58. The front surface 52 is tapered downwardly. This tapering of the front surface 52 is more comfortable for the user. Further, it assists the wheelchair user in exiting the wheelchair.

The second element 20 also has a top surface 60, a front surface 62, a rear surface 64, a right side surface 66, and a left side surface 68.

Similarly, the third element 30 has a top surface 70, a front surface 72, a rear surface 74, a right side surface 76, and a left side surface 78.

The fourth element 40 has a top surface 80, a front surface 82, a rear surface 84, a right side surface 86, and a left side surface 88.

The left side surface 78 of the third element 30 is contiguous with the right side surface 66 of the second element 20. Further, the right side surface 86 of the fourth element 40 is contiguous with the left side surface 68 of the second element 20. The interface created by these contiguous junctions is inclined relative to a vertical center plane VCP, as is most clearly seen in FIG. 4. While in the preferred embodiment the interface formed by the side surfaces 68, 86 is angled relative to a vertical plane which bisects the cushion 10, the interfaces could also be oriented differently so that they intersect any vertical plane making an angle of 90° with the horizontal plane containing the cushion 10. The angle made by the interface between side surfaces 78, 66, and 68, 86 are inclined to the vertical center plane VCP at angles between 10° and 80°. In the preferred embodiment, this angle is approximately 27°. This inclined transition between the second element 20 and the third and fourth elements 30, 40 provides a gradual transition in stiffness to the user. A more abrupt difference in stiffness between adjourning elements could cause discomfort and instability to the user. Further, the angled interface helps secure the relative positions of the second, third and fourth elements 20, 30, 40.

A plate 96 extending rearwardly from the rear surface 54 of the first element 12 also improves the structural integrity of the cushion. The second element 20, third element 30, and fourth element 40 all rest upon the plate 96. In the preferred embodiment, the plate 96 is integral with the first element 12.

With reference to FIG. 3 and 4, the distance between the top surface 50 of the first element 12 and the bottom surface of the second element 20 is denoted by X. In the preferred embodiment, this distance X is equal to 1.5 inches. This measurement is chosen so that, when the user is sitting in the cushion 10 the user's ischial tuberosities are located approximately 1.5 inches beneath a back surface of the user's thighs. The ischial tuberosities sink through the second element 20 and rest very near a top surface 98 of the plate 96. In the preferred embodiment, the thickness of the plate is 0.5 inches. The back surface of the user's thighs rest on the top surface 50 of the first element 12. Applicants have determined that the ischial tuberosities should be oriented approximately 1.5 inches beneath the back surface of the user's thighs for optimum comfort and health.

In the preferred embodiment, the width of the cushion 10 from right side to left side is equal to 18 inches, while the depth of the cushion from front to back, the sum of the distances Y, Z, and A, is also 18 inches. In the preferred embodiment, the distance Y is equal to 10 inches, the distance Z is equal to 6.5 inches and the distance A is equal to 1.5 inches. With continuing reference to FIG. 2, the average width B of the fourth element is approximately 5.5 inches, while the average width C of the second element 20 is approximately 7 inches, and the average width D of the third element 30 is approximately 5.5 inches.

In other embodiments, the width of the cushion 10 from right side to left side is equal to 12 inches while the depth of the cushion from front to back, the sum of the distances Y, Z, and A, is also 12 inches. Other dimensions are similarly reduced in order to keep the basic configuration of the cushion similar to the disclosed preferred embodiment.

In another embodiment, the width of the cushion 10 from right side to left side is equal to 14 inches while the depth of the cushion from front to back, the sum of the distances Y, Z, and A, is 18 inches. In a still further embodiment, the width of the cushion 10 from right side to left side is equal to 16 inches while the depth of the cushion from front to back is also equal to 16 inches. The thickness of the first element 12 is preferably 2 inches, although thicknesses of 3 inches have also been used successfully. It is believed that thicknesses above 4 inches are not satisfactory.

The specific dimensions of the embodiments are adapted to the specific application and depend on factors such as the dimensions of the user's body.

In the preferred embodiment, the seat cushion is comprised of polyurethane foam. The first, second, third, and fourth elements, 12, 20, 30, 40, are comprised of different stiffnesses of foam. Such stiffness variations are commonly measured in terms of an indentation load deflection (ILD). This measurement standard is known in the art and can be referenced in ASTM Standard Test D-3574-81, the disclosure of which is hereby incorporated by reference into this specification. The first element 12 should be stiff in order to assist the user in exiting the wheelchair. Typically, when exiting a wheelchair, the wheelchair user slides forward, momentarily placing all of their weight on the first element 12. If the first element 12 is stiff, the transition from the wheelchair into another waiting vehicle or bed is more easily accomplished. The stiffness of the first element 12 is between 60 ILD and 120 ILD. Preferably, the stiffness of the first element is 70 ILD.

The second element 20 should be less stiff than the first element 12. The stiffness of the second element 20 can range from 25 ILD to 35 ILD, with a preferred measurement being 30 ILD.

In the preferred embodiment, the third and fourth elements are made of the same stiffness foam. In the preferred embodiment, the third and fourth elements 30, 40 are made of 50 ILD foam, although stiffnesses between 40 ILD and 66 ILD are believed to be functional.

The higher stiffness foam in the first element 12 and in the third and fourth elements 30, 40 provide a horseshoe-type enclosure about the lower stiffness foam in the second element 20. Significant portions of the user's weight are born by the first, third and fourth elements 12, 30, 40, thereby reducing the force, and thereby the pressure, on the user's ischial tuberosities.

In the preferred embodiment, the cushions are made of polyurethane foam although it is believed other type foams are equally applicable.

The invention has been described with reference to a preferred embodiment. Obviously, modifications and alterations will occur to others upon the reading and understanding of this specification. It is intended to include all such modifications and alterations insofar as they come within the scope of the appended claims or the equivalents thereof.

Having thus described invention, it is now claimed:

1. A wheelchair cushion comprising:

a first element, said first element having a first stiffness, said first element having top, front, rear, and side surfaces;

a second element, said second element having a second stiffness, said second element having top, front, rear, and right and left side surfaces, said front surface of said second element contiguous to said rear surface of said first element;

a third element having top, front, rear, and right and left side surfaces, said right side surface of said second element being contiguous to said left side surface of said third element, said right side surface of said second element and said left side surface of said third element making an angle between 10 degrees and 80 degrees with a vertical central plane; and, a fourth element having top, front, rear, and right and left side surfaces, said left side surface of said second element being contiguous with said right side surface of said fourth element, said left side surface of said second element and said right side surface of said fourth element making an angle between 10 degrees and 80 degrees with said vertical central plane.

2. The wheelchair cushion of claim 1 wherein said first stiffness is greater than said second stiffness.

3. The wheelchair cushion of claim 1 wherein said first and second elements comprise polyurethane foam.

4. The wheelchair cushion of claim 1 wherein said first element further comprises a plate portion which extends under said second, third, and fourth elements.

5. The wheelchair cushion of claim 1 wherein an average width of said second element is between 20% and 60% of a width of said cushion.

6. The wheelchair cushion of claim 1 wherein said top surface of said first element extends rearwardly from said front surface of said cushion a distance between 20% and 60% of an average depth of said cushion.

7. The wheelchair cushion of claim 1 wherein an average width of said second element is between 4 inches and 8 inches.

8. The wheelchair cushion of claim 1 wherein said top surface of said first element extends rearwardly from said front surface of said cushion a distance between 4 inches and 10 inches.

9. The wheelchair cushion of claim 1 wherein said front surface of said first element is tapered downwardly.

10. The wheelchair cushion of claim 1, whereby said angles are between 15 and 45 degrees.

11. A wheelchair cushion having front, rear, top, and side surfaces, said cushion comprising:

a first element, said first element having top, front, rear, and side surfaces, said first element also having a first stiffness and a thickness, said front surface of said first element comprising said front surface of said cushion and selectively receiving a back surface of thighs of an associated user; and, a second element, said second element having top, front, rear, and side surfaces, said second element also having a second stiffness and a thickness, said front surface of said second element contiguous to said rear surface of said first element, said rear surface of said second element comprising said rear surface of said cushion and receiving ischial tuberosities of the associated user, said second stiffness being less than said first stiffness so that the ischial tuberosities of the associated user will be located between 1.0 inches and 2.0 inches below said back surface of the user's thighs when the user is sitting on said cushion.

12. The wheelchair cushion of claim 11 wherein said first element further comprises:

a plate, said plate extending under said second element, said plate having said first stiffness.

13. The wheelchair cushion of claim 12 wherein said plate is between 0.25 inches and 2.0 inches thick.

14. The wheelchair cushion of claim 11 further comprising:

third elements, one of said third elements being contiguous with one of said side surfaces of said second element and a second of said third elements being contiguous with the other of said side surfaces of said second element, said third elements having top, front, rear, and side surfaces, said third surfaces also having thicknesses and a third stiffness.

15. The wheelchair cushion of claim 14 wherein said third stiffness is less than said first stiffness but greater than said second stiffness.

16. The wheelchair cushion of claim 14 wherein said third elements receive an outer buttocks region of an associated user, thereby supporting the user's weight and reducing pressure on the user's ischial tuberosities.

17. The wheelchair cushion of claim 14 wherein said top surfaces of said third elements are inclined toward a vertical center plane of said cushion.

18. The wheelchair cushion of claim 14 wherein said side surfaces of said third elements are contiguous with said side surfaces of said second element, said side surfaces of said second and third elements making an angle between 10 degrees and 80 degrees with a first vertical plane.

19. The wheelchair cushion of claim 14 wherein said side surfaces of said third elements are contiguous with said side surfaces of said second element, said side surfaces of said second and third elements making an angle between 10 degrees and 80 degrees with a vertical center plane of said cushion.

20. A wheelchair cushion having front, rear, top, and side surfaces, said cushion comprising:

a first element, said first element having top, front, rear, and side surfaces, said front surface of said first element comprising said front surface of said cushion, said first element having a first stiffness; and, a second element, said second element having top, front, rear, and side surfaces, said second element having a second stiffness and a thickness, said second stiffness being less than said first stiffness, said second element being near said rear surface of said cushion and receiving the ischial tuberosities of an associated user, said top surface of said second element being between 1.0 inches and 2.0 inches below said top surface of said first element so that the ischial tuberosities of the associated user will be located between 1.0 inches and 2.0 inches below a back surface of the user's thighs when said user is sitting on said cushion and said user's thighs are received onto said first element.

21. A wheelchair cushion having front, rear, top, and side surfaces, said cushion comprising:

a first element, said first element having top, front, rear, and side surfaces, said first element also having a first stiffness and a thickness, said first element selectively receiving the back surface of the thighs of an associated user; and, a second element, said second element having top, front, rear, and side surfaces, said second element also having a second stiffness and a thickness, said second stiffness being between 20% and 60% of said first stiffness, said second element receiving ischial tuberosities of an associated user, said second stiffness being less than said first stiffness so that a greater portion of the associated user's weight will be borne by the user's thighs, said top surface of said second element being between 1.0 inches and 2.0 inches below said top surface of said first element so that the ischial tuberosities of the associated user will be located between 1.0 inches an 2.0 inches below a back surface of the user's thighs when said user is sitting on said cushion and said user's thighs are received onto said first element.

22. The wheelchair cushion of claim 21 further comprising:

third elements, one of said third elements being located adjacent one side of said second element and a second of said third elements being located on the other side of said second element, said third elements having top, front, rear, and side surfaces, said third elements also having a third stiffness, said third stiffness being between 30% and 100% of said first stiffness, said third elements selectively receiving outer portions of said user's buttocks, thereby further lessening the weight borne by the user's ischial tuberosities.

23. A wheelchair cushion having front, rear, top, and side surfaces, said cushion comprising:

a first element, said first element having top, front, back, and side surfaces, said first element also having a first stiffness and a thickness, said first stiffness being between 60 ILD and 120 ILD, said first element selectively receiving the thighs of an associated user; and, a second element, said second element having top, front, back, and side surfaces, said second element also having a second stiffness and a thickness, said second stiffness being between 25 ILD and 35 ILD, said second element receiving the ischial tuberosities of the associated user, said second stiffness being less than said first stiffness so that a greater portion of the associated user's weight will be borne by the user's thighs, said top surface of said second element being between 1.0 inches and 2.0 inches below said top surface of said first element so that the ischial tuberosities of the associated user will be located between 1.0 inches an 2.0 inches below a back surface of the user's thighs when said user is sitting on said cushion and said user's thighs are received onto said first element.

24. The wheelchair cushion of claim 23 further comprising:

third elements, one of said third elements being located adjacent one side of said second element and a second of said third elements being located on the other side of said second element, said third elements having top, front, rear, and side surfaces, said third surfaces also having a third stiffness, said third stiffness being between 40 ILD and 65 ILD, said third elements selectively receiving outer portions of said user's buttocks, thereby further lessening the weight borne by the user's ischial tuberosities.

25. A wheelchair cushion, said cushion having front, rear, right side, left side, and top surfaces, said cushion also having a width, a thickness, a depth, and a vertical center plane, said cushion comprising:

a first element, said first element having front, rear, right side, left side, and top surfaces, said first element also having an average depth, an average width, and an average thickness, said front surface of said first element being tapered downwardly, said first element comprising polyurethane foam having a first stiffness, said first stiffness being between 60 ILD and 120 ILD, said first element also comprising a plate portion, said plate portion extending rearwardly from said front surface of said cushion to said rear surface of said cushion;

a second element, said second element having front, rear, right side, left side, and top surfaces, said second element also having an average depth, an average width, and an average thickness, said front surface of said second element being contiguous with said rear surface of said first element, said second element being centered on said vertical center plane of said cushion, said second element having a second stiffness, said second stiffness being between 25 ILD and 35 ILD;

a third element, said third element having front, rear, right side, left side, and top surfaces, said third element also having an average depth, an average width, and an average thickness, said right side surface of said third element being contiguous to said left side surface of said second element, said right side surface of said third element and said left side surface of said second element making an angle between 10 degrees and 80 degrees with a vertical plane, said top surface of said third element slanting inwardly toward said vertical center plane, said third element having a third stiffness, said third stiffness between 40 ILD and 65 ILD; and, a fourth element, said fourth element having front, rear, right side, left side, and top surfaces, said fourth element also having an average depth, an average width, and an average thickness, said left side surface of said fourth element being contiguous to said right side surface of said second element, said left side surface of said fourth element and said right side surface of said second element making an angle between 10 degrees and 80 degrees with said vertical plane, said top surface of said fourth element slanting inwardly toward said vertical center plane, said fourth element having a fourth stiffness, said fourth stiffness between 40 ILD and 65 ILD.

* * * * *